US005207353A

United States Patent [19]

Corby et al.

[11] Patent Number: 5,207,353

[45] Date of Patent: May 4, 1993

[54] METHODS OF AND APPARATUS FOR REPLENISHING TONER IN ELECTROSTATOGRAPHIC DEVELOPMENT STATIONS

[75] Inventors: Kenneth D. Corby; Victoria L. Decker, both of Rochester, N.Y.

[73] Assignee: Eastman Kodak Company, Rochester, N.Y.

[21] Appl. No.: 894,977

[22] Filed: Jun. 8, 1992

[51] Int. Cl.[5] ..... G03G 15/06

[52] U.S. Cl. ..... 222/1; 222/325; 222/DIG. 1; 355/260; 141/364; 220/351; 220/359

[58] Field of Search ..... 222/1, 325, 541, DIG. 1; 355/215, 260; 141/363, 364, 365, 366, 383; 220/351, 359; 206/527

[56] References Cited

U.S. PATENT DOCUMENTS

| | | | |
|---|---|---|---|
| 4,062,385 | 12/1977 | Katusha et al. | 141/89 |
| 4,304,273 | 12/1981 | Caudill et al. | 141/268 |
| 4,491,161 | 1/1985 | Tamura et al. | 141/364 |
| 4,573,614 | 3/1986 | Ozawa | 222/542 |
| 4,589,579 | 5/1986 | Morita | 222/561 |
| 4,878,091 | 10/1989 | Morita et al. | 355/260 |
| 4,924,920 | 5/1990 | Bhagwat | 141/98 |
| 4,997,016 | 3/1991 | Hacknauer et al. | 222/DIG. 1 X |
| 5,018,560 | 5/1991 | Tsukamoto | 141/364 |
| 5,091,750 | 2/1992 | Yoshida et al. | 141/364 X |

*Primary Examiner*—Andres Kashnikow
*Assistant Examiner*—A. Pomrening
*Attorney, Agent, or Firm*—Lawrence P. Kessler

[57] ABSTRACT

Methods of and apparatus for adding toner to an electrostatographic development station from a flat-flanged container containing toner minimizes spillage of toner by automatically uncovering and recovering the container. The flat-flanged container has a mouth surrounded by a peripheral flange which is covered by a flexible cover folded upon itself and adhered to the flange. A slide cover is slidably mounted on the flange with the flexible cover attached at one end to the slide cover. The container is emptied by inserting the container into a sump lid positioned over a hopper within the electrostatographic development station and moving the container so that the mouth of the container is in alignment with an opening through the sump lid. As the container is moved into alignment with opening, the slide cover is automatically removed from the container simultaneously peeling the flexible cover from the flange and opening the container to empty the toner. As the container is slid back to its initial position, the flexible cover readheres to the flange and the slide cover is automatically slidably received back over the flange. The container is then removed from the sump lid and disposed of.

14 Claims, 10 Drawing Sheets

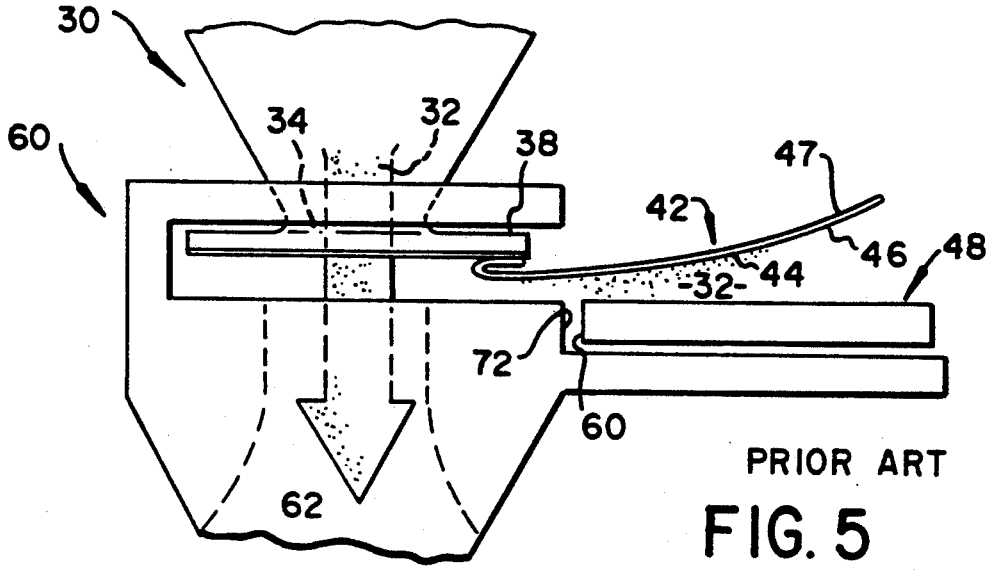
PRIOR ART
FIG. 5
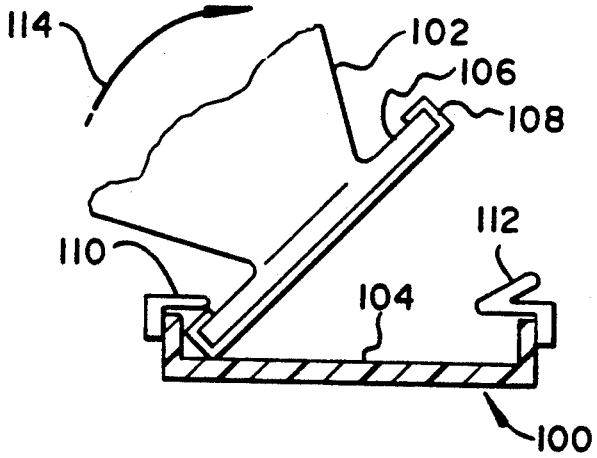
FIG. 6
FIG. 7
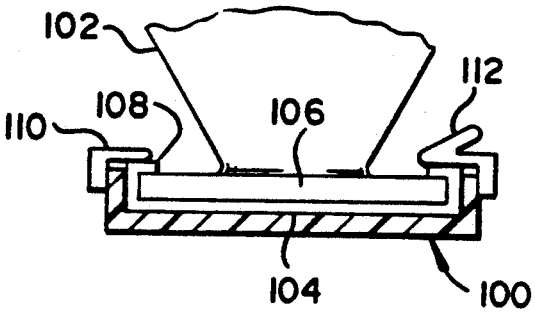

METHODS OF AND APPARATUS FOR REPLENISHING TONER IN ELECTROSTATOGRAPHIC DEVELOPMENT STATIONS

BACKGROUND OF THE INVENTION

1. Technical Field

This invention relates to image development in electrostatographic copiers or printers, and more particularly to improvements in methods of and apparatus for replenishing toner in electrostatographic development stations.

2. Prior Art

Electrophotographic copiers and printers utilize toner particles dispensed from a development station to develop latent electrostatic images on image-bearing members such as, for example, photoconductors. The quantity of toner particles is gradually depleted through use and must be replenished periodically.

Replenishing toner particles can be an inefficient, messy, and expensive procedure due to the nature of toner particles, which usually consist of very fine thermoplastic particles pigmented with carbon black or coloring pigments. These particles are susceptible to forming powder clouds if blown or aerated. Blowing or aeration can easily result when handling toner containers, which are usually flexible so that the particles are aerated when the containers are squeezed. Not only are toner clouds messy, they can also cause maintenance problems for other components of the copier or printer if toner is deposited on sensitive components of the machine.

The patent literature includes a number of patents directed to the concept of a toner container having a flexible cover overlain by a slide cover received on a flange flush with the mouth of the container. Exemplary of such patents are U.S. Pat. Nos. 4,062,385; 4,573,614; 4,589,579; and 4,491,161. None of these patents discloses an arrangement for opening the containers to empty their contents and thereafter effectively resealing the empty containers with the flexible covers, wherein both operations are accomplished by sliding the containers on the electrostatographic development stations with which the containers are used.

In view of the limitations of the prior art, there is a need for improved arrangements for emptying toner containers closed with flexible covers wherein the containers are automatically resealed with the same flexible covers.

SUMMARY OF THE INVENTION

It is an object of the instant invention to provide improvements in methods of and apparatus for uncovering and recovering the mouth of a toner bottle or container which is covered by both a flexible cover and a relatively inflexible slide cover.

The instant invention contemplates a toner dispensing apparatus and method for dispensing toner to an electrostatic reproducing machine from a toner container having a mouth with a flange extending therearound. The mouth of the container is covered by a flexible cover having a portion releasably adhered to the flange by a layer of adhesive. The flexible cover has first and second ends, the first end being fixed to the flange. A slide cover overlies the flexible cover and is slidably received on the flange. The slide cover has first and second ends with the second end of the flexible cover being fixed to the slide cover proximate one end thereof. The toner container is received in the first station of a sump lid having first and second stations with the second station having an opening through which toner from the container pours. The sump lid engages the slide cover to retain the slide cover at the first station when the toner container is moved to the second station, wherein the flexible cover is peeled from the flange to open the bottle as the toner container is moved. When the toner container is moved from the second station back to the first station, frictional drag insures that the flexible cover readheres properly to the flange and recovers the mouth of the container. As the flexible cover recovers the mouth of the container the slide cover slidably receives the flange. The container can then be disposed of with the flexible cover secured thereto.

BRIEF DESCRIPTION OF THE DRAWINGS

Various other objects, features, and attendant advantages of the present invention will be more fully appreciated as the same becomes better understood when considered in conjunction with the accompanying drawings, in which like reference characters designate the same or similar parts throughout the several views and wherein:

FIG. 5 is a schematic view similar to FIG. 4 showing the flexible cover being completely removed from the toner bottle to empty toner therefrom;

FIGS. 6 and 7 are schematic side views illustrating preliminary steps prior to practicing the first embodiment of the invention;

DETAILED DESCRIPTION

Figure 1:
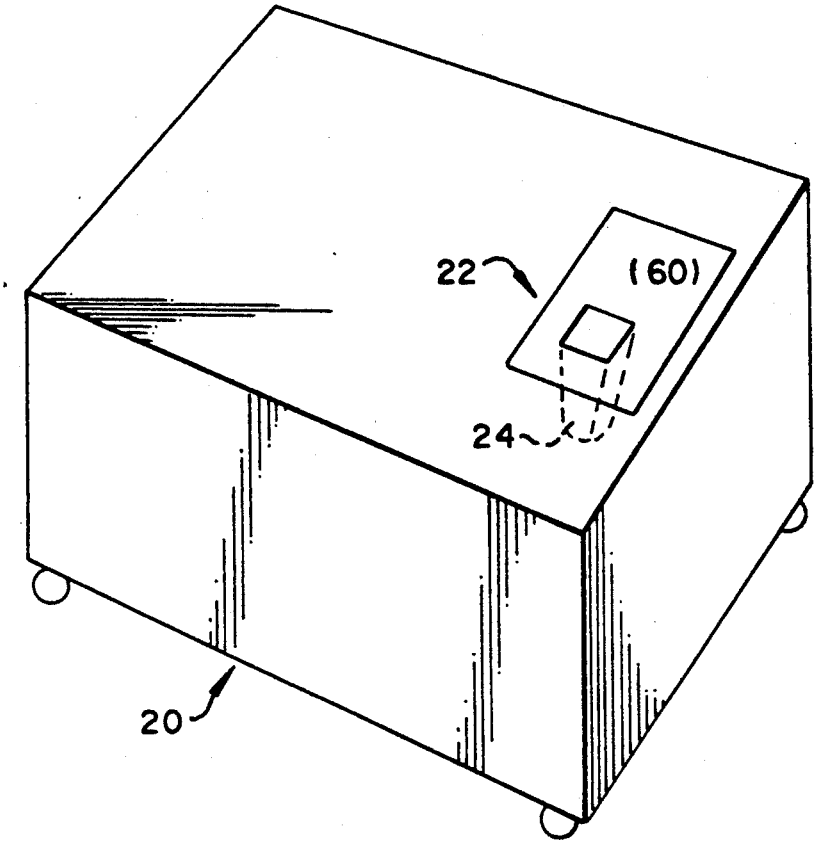
FIG. 1 is a perspective view of an electrostatic copier showing the location of a sump lid station for the introduction of toner utilizing the apparatus of the instant invention.

Referring now to FIG. 1, there is shown an electrostatographic development station, designated generally by the numeral 20, which may be, for example, an electrostatic copier such as, for example, Models EK-85 or EK-90, of the Eastman Kodak Company. The electrostatic copier 20 includes at one end thereof a sump lid station, designated generally by the numeral 22, which is configured in accordance with the principles of the instant invention to communicate with a hopper 24 within the development station.

Figure 2:
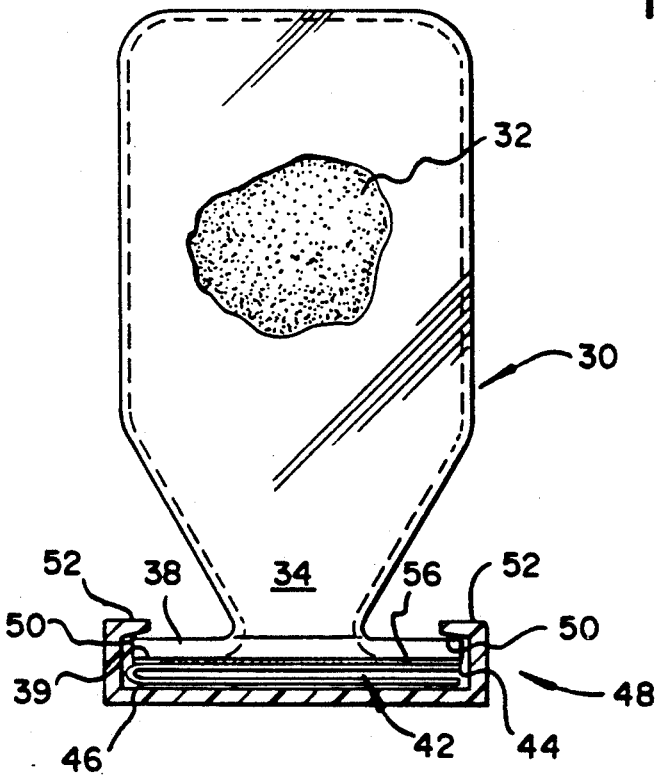
FIG. 2 PRIOR ART
FIG. 2 is a side view of a bottle containing toner particles which are dispensed into the electrostatic copier of FIG. 1.
Figure 3:
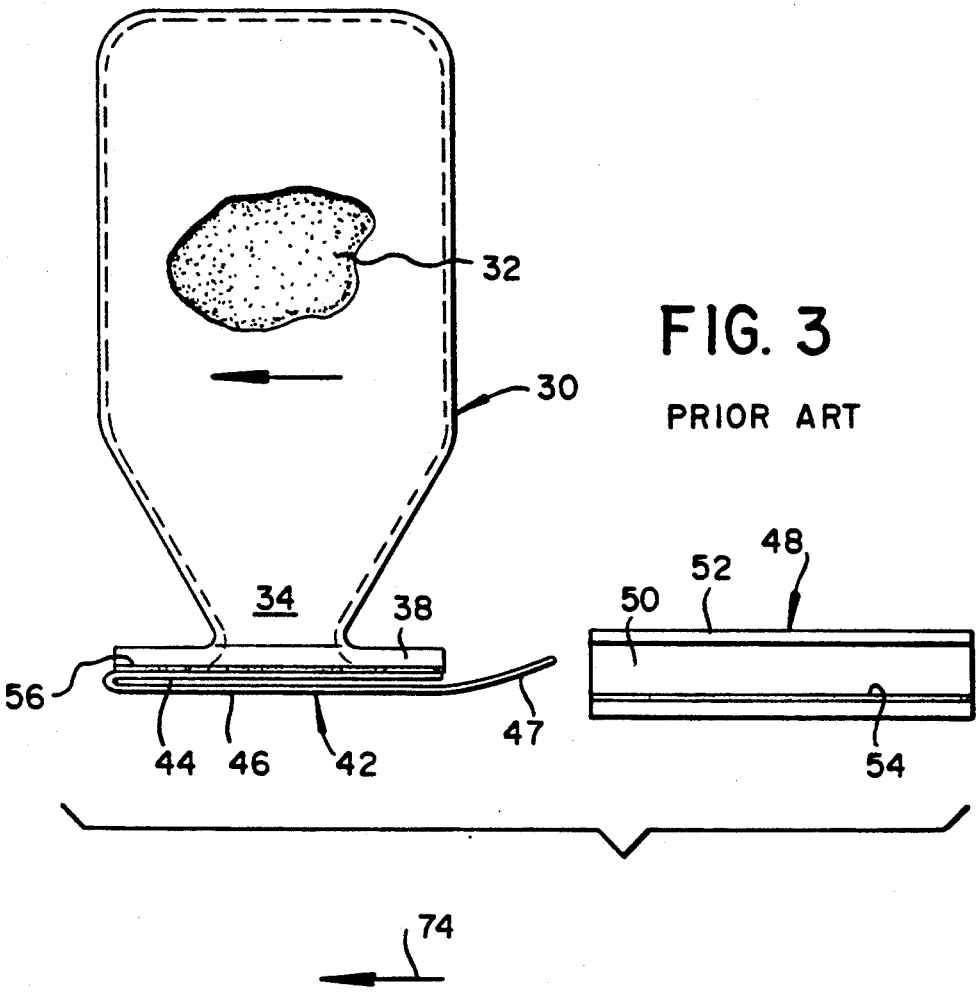
FIG. 3 PRIOR ART
FIG. 3 is a front view of the bottle of FIG. 2 but with a slide cover detached therefrom.

Referring now to FIGS. 2 and 3, there is shown a toner bottle, designated generally by the numeral 30, containing toner 32, which is dispensed through the mouth 34 of the toner bottle. The toner bottle 30 is of a type currently in use but has general structural characteristics utilized in practicing the methods and apparatus of the instant invention. The bottle 30 includes standard features such as a bottle flange 38 having a bottom surface 39 which is flush with the opening 34 of the bottle, and a flexible cover 42 having a first portion 44 in abutment with the bottom surface of the bottle flange, a second portion 46 folded over the first section and a pull tab portion 47. Slidably received over the bottle flange 38 is a slide cover, generally designated by the numeral 48, which has a pair of slots 50—50 defined by lips 52—52, which slots receive the bottle flange 38 and the flexible cover 42.

The slide cover 48 has a foam lining 54, while the first portion of the flexible cover 42 has a releasable adhesive layer 56 which adheres the first portion 44 to the bottle flange 38. As is seen in FIG. 3, when the slide cover 48 is slid from the bottle flange 38, the flexible cover 42 may then be pealed from the bottle flange by pulling on the tab portion 47 so that the toner 32 is dispensed therefrom through the mouth 34 of the bottle 30.

The Prior Art

Figure 4:
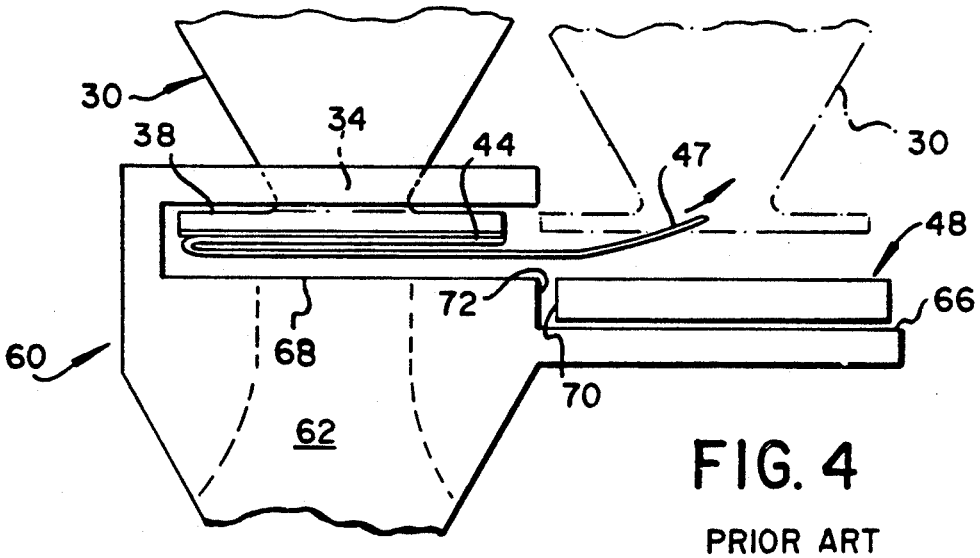
FIG. 4 PRIOR ART
FIG. 4 is a schematic front view illustrating a current arrangement wherein a flexible cover is being pulled from the toner bottles of FIGS. 2 and 3 after a slide cover on the bottle has been slidably removed in a sump lid.

Referring now to FIGS. 4 and 5, there is shown a currently practiced method and apparatus for emptying a toner bottle, such as the toner bottle 30, through a sump lid, designated generally by the numeral 60, which is disposed at a sump lid station, such as the sump lid station 22 of the copier or printer 20 of FIG. 1. The sump lid 60 is aligned with the hopper 24 located within the copier or printer 20 and is connected thereto by an opening 62 through the sump lid. The sump lid 60 has a first station 66 for retaining the slide cover 48 and a second station 68 aligned with the opening 62.

As is shown in dotted lines, a toner bottle, such as the toner bottle 30 of FIGS. 2 and 3, is initially placed in the first station 66 of the sump lid with the slide cover 48 having a surface 70 engaging an abutment 72 on the sump lid 60. When the bottle 30 is slid in the direction of arrow 74 to the second station 68 of the sump lid 60, the mouth 34 of the bottle is aligned with the opening 62 through the sump lid. The flexible cover 42 is then gripped at tab portion 47 by the operators' fingers and pulled to uncover the mouth 34 of the bottle 30 so that the toner 32 in the bottle flows out through the mouth, through the opening 62 in the sump lid 60 and into the hopper 24 within the copier or printer 20 (FIG. 1). As is seen in FIG. 5, once the flexible cover 42 is pulled free of the flange 38, loose toner particles 32 on the surface of portion 44 of the flexible cover deposit on the top surface of the slidable cover 48, which is exposed to the surrounding environment. In addition, the cover 42 is discarded with loose toner 32 thereon. During the process of pulling and discarding the flexible cover 42, some of the loose toner may get on the hands or clothes of the operator, as well as on the copier or printer 20. This can result in a somewhat messy environment, with the attendant results of a messy environment.

The three embodiments of FIGS. 6–13, 14–17, and 18–21 disclose structures and methods for minimizing the possible mess by confining to the bottle 30 and its attendant structure toner 32 that does not enter the hopper 24 upon emptying the bottle.

First Embodiment of the Improvement: FIGS. 6–13

Referring now to FIGS. 6 and 7, a sump lid, designated generally by the numeral 100, and disposed at the sump lid station 22 of FIG. 1, is shown in elevation to illustrate how a toner bottle 102 is initially mounted in the sump lid. The sump lid 100 is similar in many, but not all, respects to the sump lid 60 of FIGS. 4 and 5, while the toner bottle 102 is similar in many, but not all, respects to the toner bottle 30 of FIGS. 2–5. In order to mount the toner bottle 102 in a first station 104 of the sump lid 100, a bottle flange 106 over which a slide cover 108 is positioned, is inserted under a first lip 110 and then snapped under a second resilient lip 112 by rotating the toner bottle in the direction of the arrow 114 so that the toner bottle assumes the position of FIG. 7.

Figure 8:
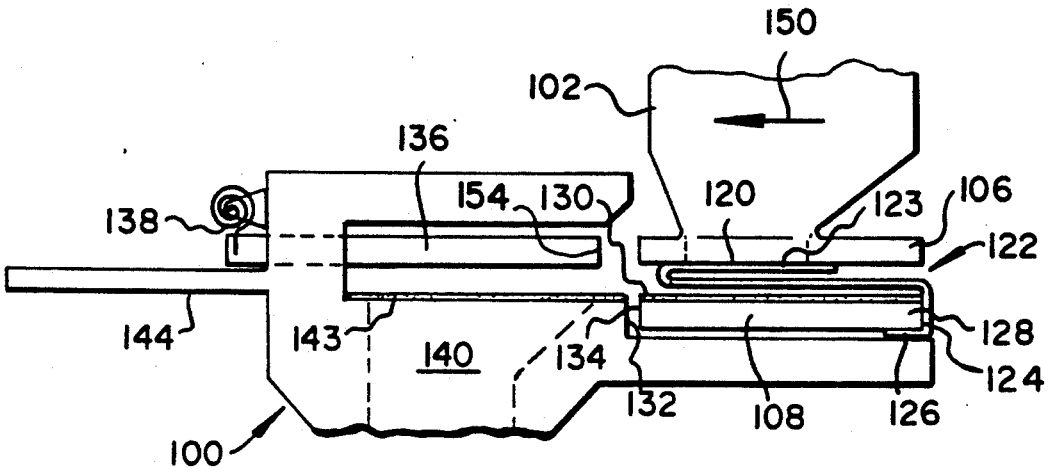
FIGS. 8–11 are schematic front views with parts spaced for clarity showing the structures and steps of the first embodiment of the invention.

Referring now to FIG. 8, the sump lid 100 with the toner bottle 102 mounted in the first station 104 thereof is shown in a front view where the novel configuration of the toner bottle is apparent. The toner bottle 102 has its bottle opening 120 disposed off-center, as compared with the bottle opening 34 of FIG. 2. Specifically, the bottle opening 120 is disposed at about one-half the length of the flange 106 instead of being centered on the flange. In addition, the flexible cover 122 (adhered over portion 123 to flange 106) has an end portion 124 which is anchored to the slidable cover 108 at a location 126 proximate a first end 128 of the slide cover 108. The slide cover 108 also has a lining of foam 130 thereon, similar to the lining of foam 54 on the slidable cover 48 of FIGS. 2 and 3. As with the current practice illustrated by FIGS. 4 and 5, the sump lid 100 has a shoulder 132 which abuts a surface, such as the end surface 134 of the slide cover 108, to retain the slide cover 108 in the first section 104 of the sump lid. The sump lid 100 also has a spring-loaded sump cover 136, which is biased by a coil spring 138 to normally cover an opening 140 through the second station 142 of the sump lid 100. A foam seal 143 in the second station 142 surrounds the opening 140 and a support shelf 144 projects away from the sump lid 100 to support the spring-loaded sump cover 136 when the sump cover is moved from the position of FIG. 8 to the position of FIG. 9.

Figure 9:
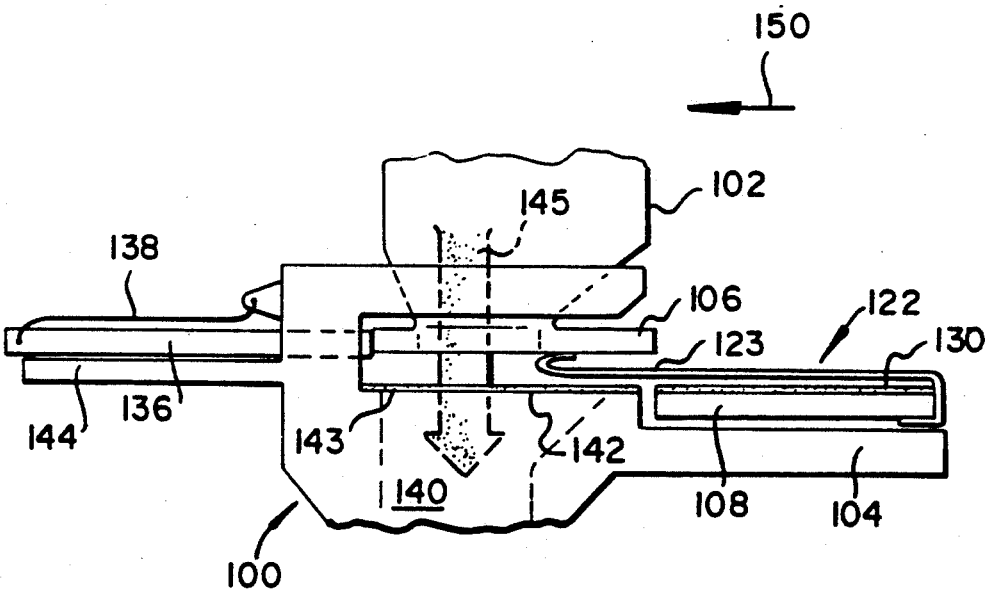

Referring now to FIG. 9, it is seen that when the toner bottle 102 is slid in the direction of arrow 150 away from the first station 104 into the second station 142 of sump lid 100, the mouth 120 of the bottle aligns with opening 140 to allow the toner 145 to empty through the mouth of the bottle, pass through the opening 140 and into the hopper 24 (FIG. 1). As the toner bottle 102 is slid in the direction of arrow 150, the bottle flange 106 abuts the end 154 of the spring-loaded sump cover 136 and pushes the cover 136 against the bias of the spring 138 out onto the shelf 144, thereby uncovering the opening 140 so that the toner 145 can pass through the opening.

As is seen in FIG. 9, the slide cover 108 is retained in the first section 104 as the toner bottle 102 is slid in the direction of arrow 150 to the second section 142. This is because the end 134 of the slide cover 108 abuts the shoulder 132 at the juncture between the first and second stations 104 and 142, respectively, of the sump lid 100. Since the flexible cover 122 has one end 124 anchored to the first end of the slide cover 108, the flexible cover peels back from the opening 120, thereby allowing toner 145 to empty from the toner bottle 102. Since the opening 120 of the toner bottle 102 is proximate the end of the toner bottle nearest the second section 142 of the sump lid 100, the toner bottle does not begin emptying until it has advanced into the second section 142 of the sump lid, minimizing the amount of toner 145 which can escape into the environment proximate the sump lid.

Figure 10:
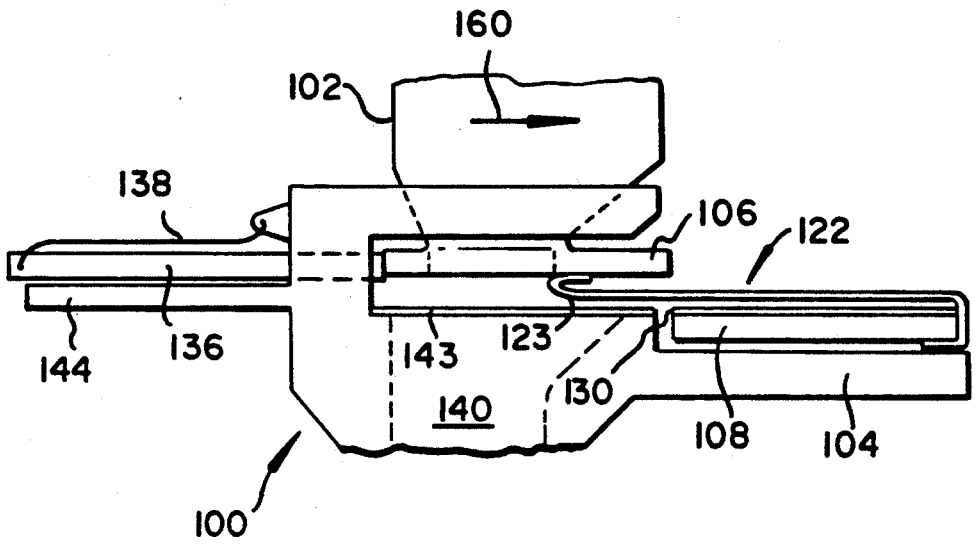
Figure 11:
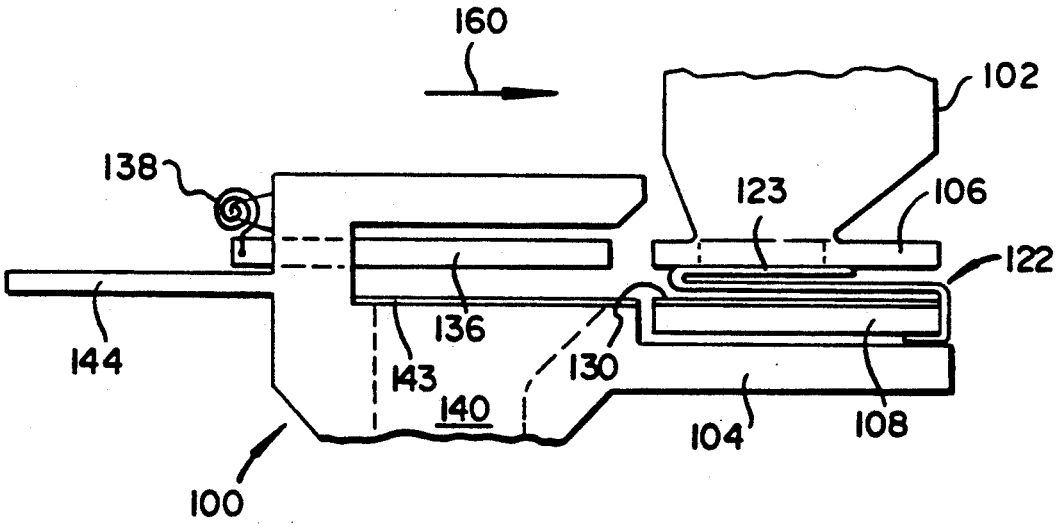

Referring now to FIGS. 10 and 11, it is seen that after the toner bottle 102 is emptied, it is moved in the direction of arrow 160 from the second station 142 back toward the first station 104. As the bottle 102 is slid, the bottle flange 106 allows the spring-loaded sump cover 136 to return under the bias of spring 138 to its position over the opening 140 (see FIG. 11). Since the flexible cover 122 has a releasable, tacky adhesive on the surface of the portion 123, the flexible cover 122 readheres itself to the bottle flange 106. In addition, the friction between the flexible cover 122 and the surfaces of the foam seal 143 and the foam covered surface 130 of the slide cover 108, causes the flexible cover 122 to slide minimally with respect to the slide cover 108 as the toner bottle 102 is slid in the direction of arrow 160. Consequently, the mouth 120 of the bottle 102 is resealed by the flexible cover 122 and recovered by the slide cover 108, which slidably receives the toner bottle flange 106.

Figure 12:
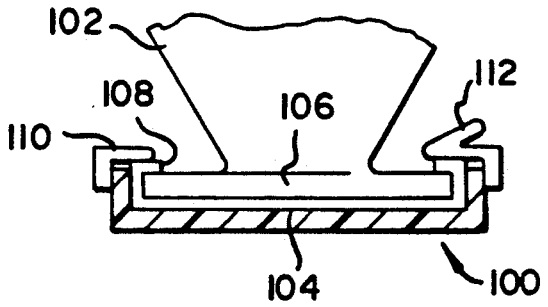
FIGS. 12 and 13 are schematic side views showing conclusionary after completing the steps of the first embodiment.
Figure 13:
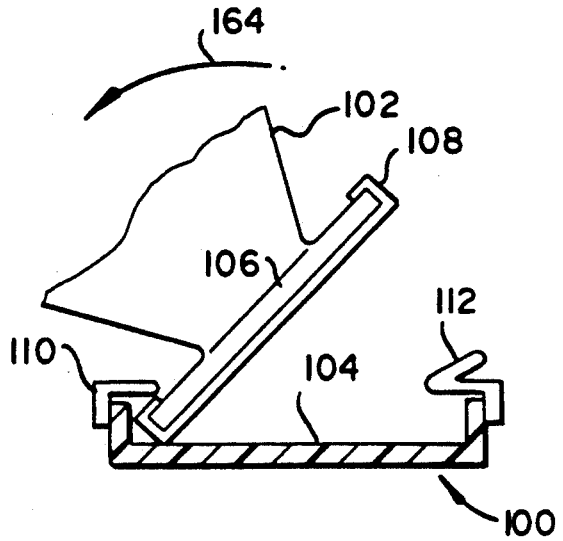
Figure 14:
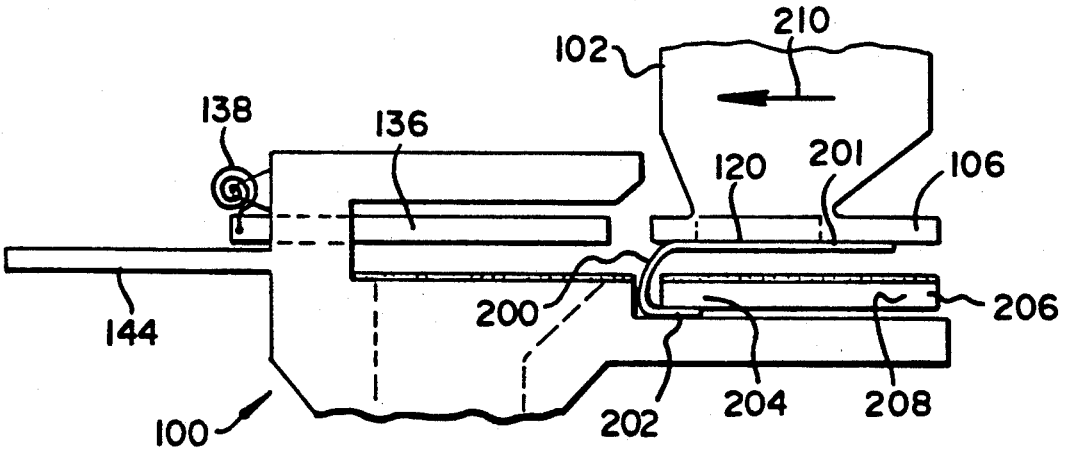
FIGS. 14–17 are schematic front views with parts spaced for clarity illustrating the steps of a second embodiment of the instant invention.

As is seen in FIGS. 12 and 13, the toner bottle 102 is then rotated in the direction of arrow 164 so as to snap from beneath the resilient lip 112, holding the toner bottle in the first section 104 of the sump lid 100. In this way, the toner bottle 102 is closed with the flexible cover 122 and the flexible cover need not be separately disposed of, but rather is disposed of with the resealed toner bottle.

Second Embodiment of the Invention: FIGS. 14–17

In the second embodiment of FIGS. 14–17, both the sump lid and toner bottle have substantially the same configurations as the first embodiment and the sump lid is again identified by reference numeral 100, while the bottle is identified by reference numeral 102. The steps of FIGS. 6 and 7 are used to mount the toner 102 in the sump lid 100 and after the toner has been emptied from the bottle 102 in accordance with the steps of FIGS. 14–17, the toner bottle is removed from the sump lid 100 in the same manner as FIGS. 12 and 13 of the first embodiment.

Figure 15:
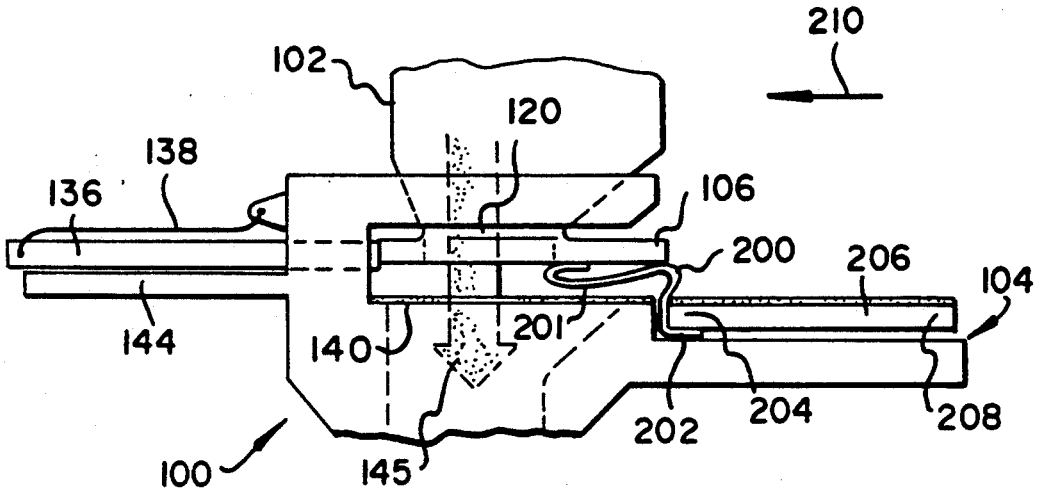

Considering now the structure and steps of the second embodiment, it is seen that the fundamental difference between the second embodiment and the first embodiment is that in the second embodiment, the flexible cover 200. releasably adhered to the bottle flange over portion 201, has a first end 202, which is anchored to the second end 204 of the slide cover 206 rather than to the first end 208 of the slide cover. The flexible cover 200 is, therefore, not folded back upon itself, as is the case with the flexible cover 42 of FIGS. 2–5 and the flexible cover 122 of the first embodiment. As with the first embodiment of the invention, when the toner bottle 102 is slid to the left in the direction of arrow 210, the flexible cover 200, which is adhered to the bottle flange 106, is stripped or peeled from the mouth 120 of the bottle to open the bottle. As is seen in FIG. 15, the flange cover 106 pushes the spring-loaded sump cover 136 from over the opening 140, allowing the contents 145 of the bottle 102 to dump into the sump 24 of the development station (FIG. 1).

Figure 16:
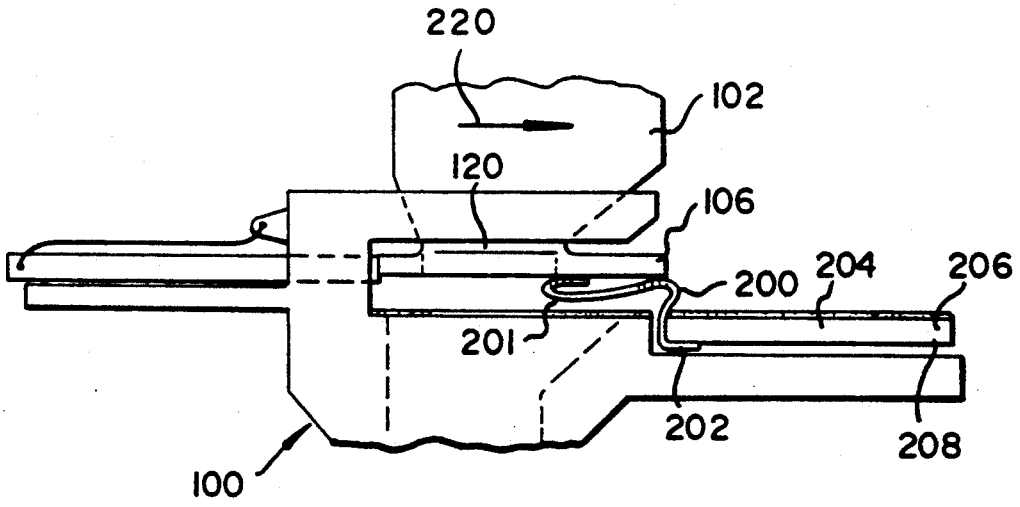
Figure 17:
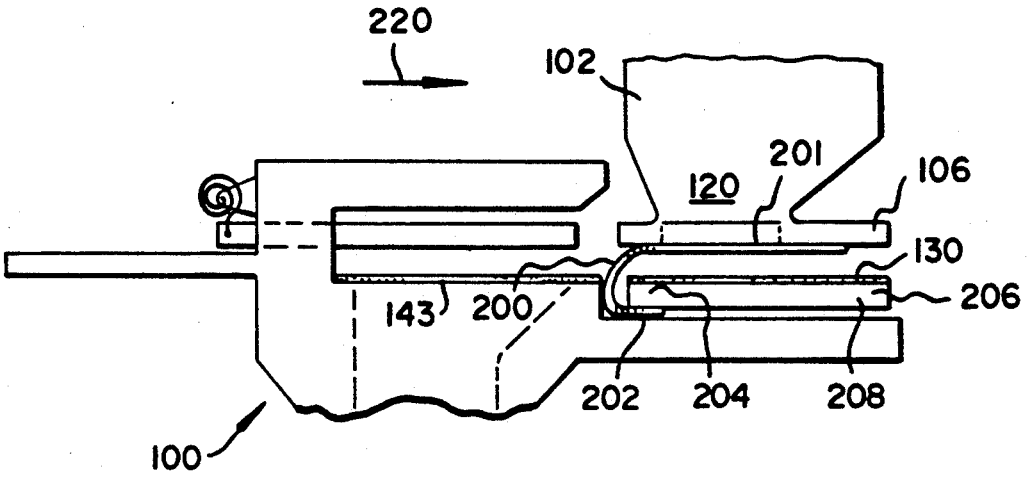
Figure 18:
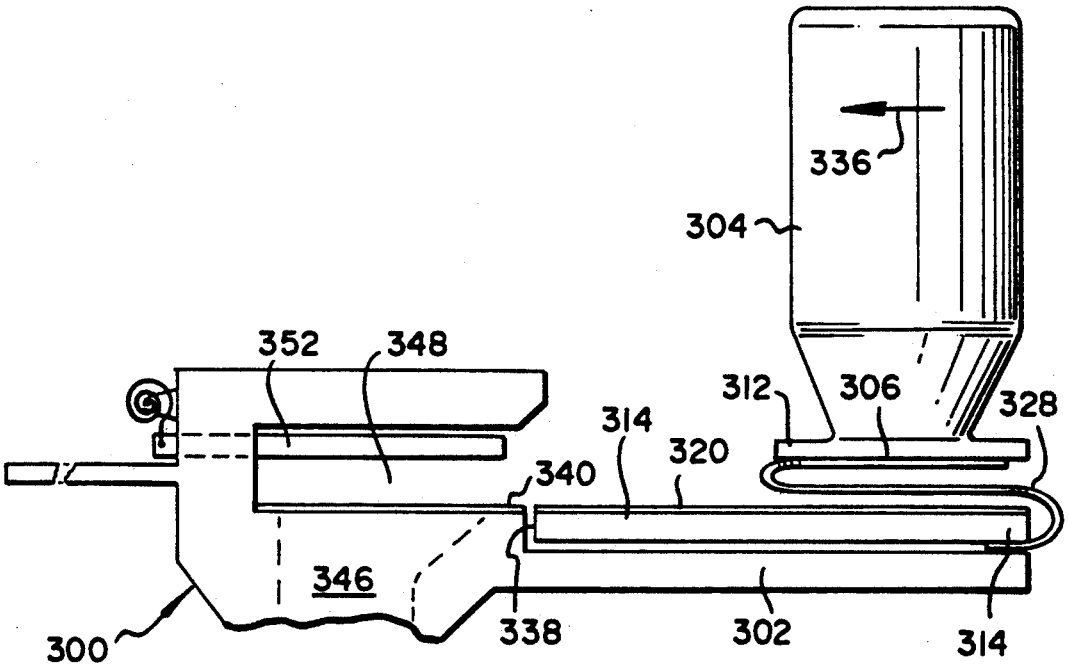
FIGS. 18–22 are schematic views illustrating the structure and steps of a third embodiment of the instant invention, with FIGS. 18-21 being front views with parts spaced for clarity and FIG. 22 being a side view.

As is seen in FIG. 16, after the toner 145 has emptied from the bottle 102, the bottle 102 is slid in the direction of arrow 220 so that the bottle flange 106 is again slidably received by the slide cover 206. Again, there is a layer of foam provided by the foam seal 143, which causes a drag on the bottle sealing surface 201 of the flexible cover 200. As the toner bottle 102 moves in the direction 220, it pulls the bottom surface 201 of the flexible cover 202 free of the foam seal 143 and causes the bottom surface to readhere to the bottle flange 106. As is seen in FIG. 17, the flexible cover 200 recovers the mouth 120 of the bottle 102, with the slide cover 206 slidably receiving the bottle flange 106. As with the first embodiment the opening 140 in the second station 142 of the sump lid 100 is recovered by the spring-loaded sump cover 136.

After the bottle 102 has been resealed by the cover 200 and slide cover 206, it is removed from the sump lid 100 in accordance with the steps of FIGS. 12 and 13 of the first embodiment and thereafter disposed of.

Third Embodiment of the Improvement: FIGS. 18–22

In the third embodiment of FIGS. 18–22, the sump lid is identified generally by the reference numeral 300 because it has structure which substantially differs in at least one respect from the structure of the sump lid 100 of the first and second embodiments. The sump lid 300 has a first station 302, which is substantially longer than the first station 104 of the first and second embodiments. Moreover, the toner bottle 304 of the third embodiment is different from the toner bottle 102 of the first and second embodiments because the toner bottle 304 has a centrally located mouth 306, similar to the centrally located mouth 34 of the bottle 30 illustrated in FIGS. 2–5.

As is seen in each of the FIGS. 18–22, the bottle 304 has a bottle flange 312 flush with the mouth 306 thereof and a slide cover 314 which is twice as long as the slide covers 108 and 206 of the first and second embodiments, respectively. As is seen in the end view of FIG. 22 the slide cover 314 has a pair of closed lips 316—316 defining slots 318—318, which extend the entire length of the slide cover 314 and hold the bottle flange 312 in engagement with a foam surface layer 320 on the slide cover.

As with the first and second embodiments, the mouth 306 of the toner bottle 304 is covered with a flexible cover 328. The flexible cover 328 has one end 330 anchored to a first end 332 of the slide cover 314 and has a length slightly longer than the slide cover.

As the bottle 304 is slid in the direction of arrow 336, the second end 338 of the slide cover 314 abuts a shoulder 340 on the sump lid 300 to hold the slide cover 314 in the first section 302 of the sump lid 300.

Figure 19:
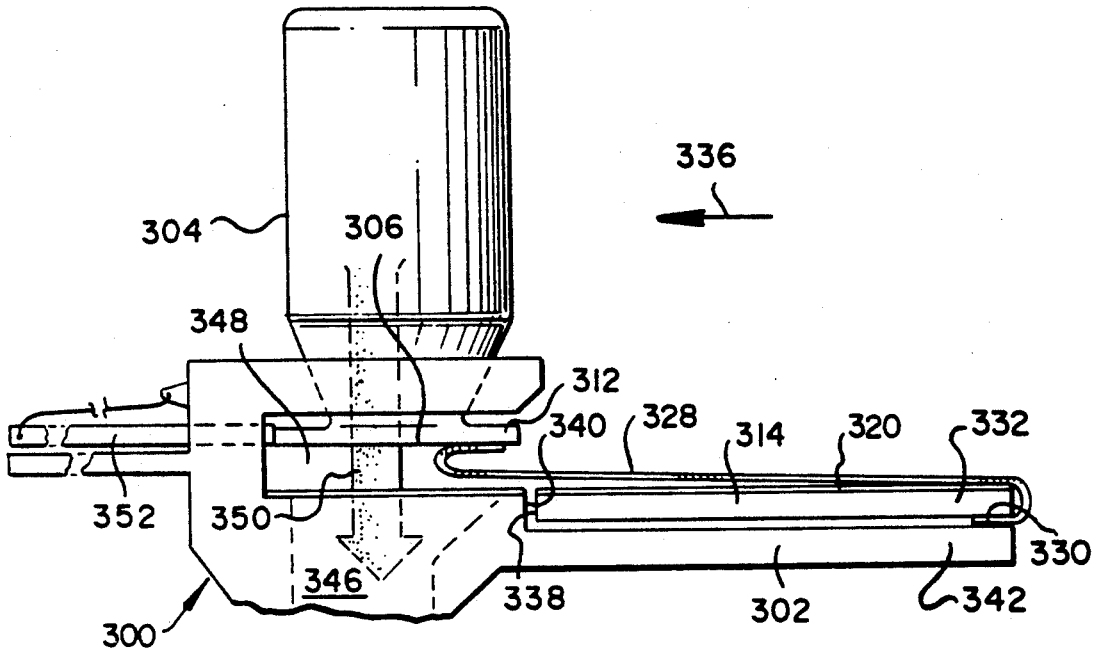
Figure 22:
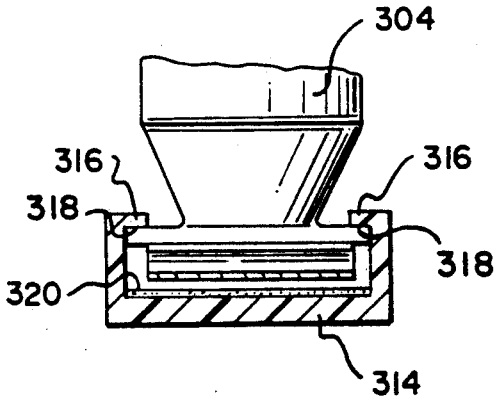

As is seen in FIG. 19, the toner bottle 304 aligns itself with an opening 346 and a second station 348 of the sump lid 300 so as to empty toner 350 through the opening 346 into a hopper 24 in an electrostatographic development station (FIG. 1). Preferably, a spring-biased sump cover 352 is biased to close the opening 346 but is pushed aside by the bottle flange 312 on the bottle 304 when the bottle is slid to the station 348 to the empty the toner 350.

Figures 20, 21:
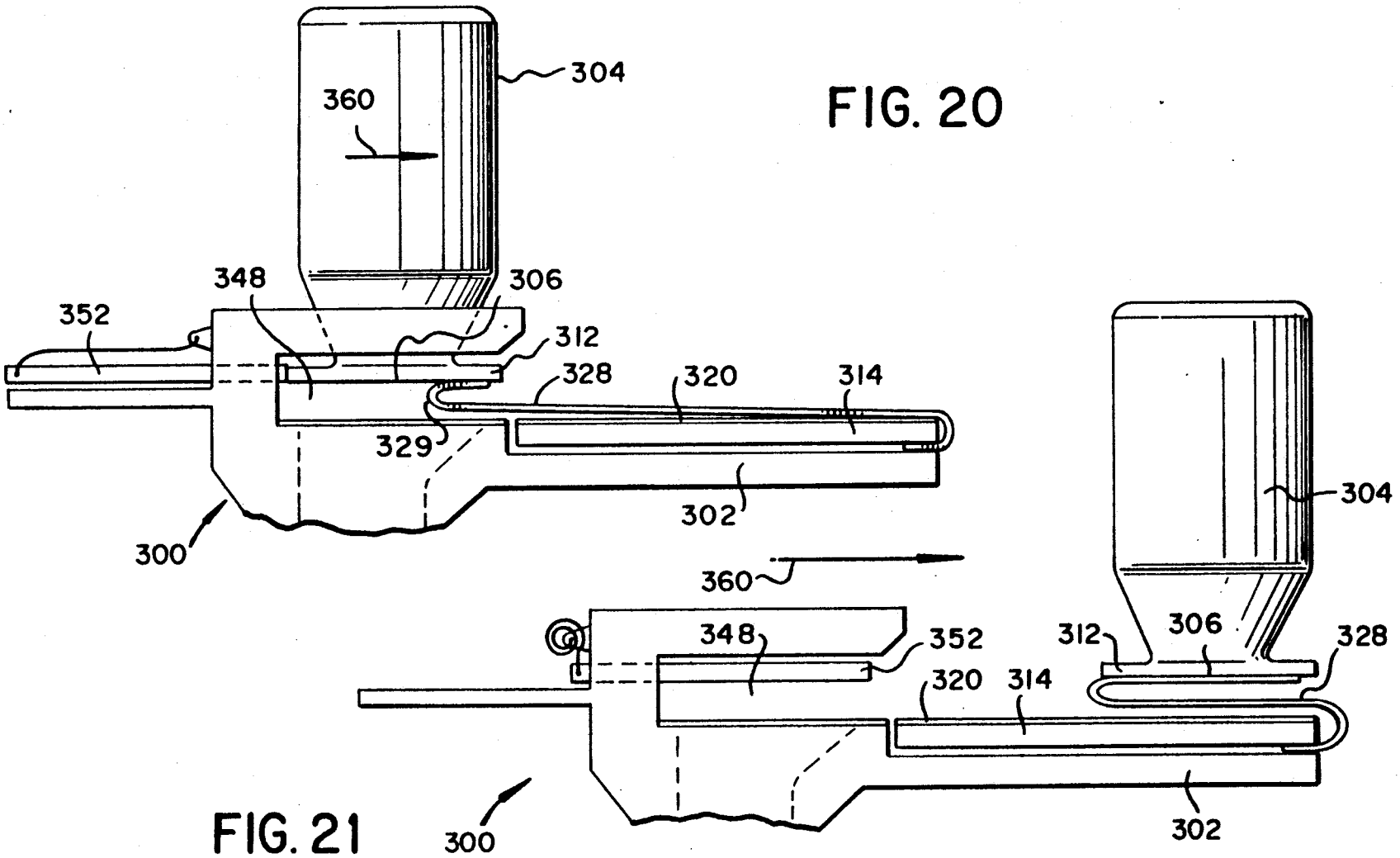

As is seen in FIGS. 20 and 21, after the toner bottle 304 is emptied, it is moved in the direction of arrow 360 so that the slidable cover 314 again slidably receives the bottle flange 312. Since the slide cover 314 has the foam layer 320 thereon, the tacky lower surface 329 of the flexible cover 328 does not readily slide with respect to the slide cover 314 but rather readheres itself to the bottom surface of the bottle flange 312. As is seen in FIG. 21, the now-empty toner bottle (304) is resealed and ready for disposal. The empty toner bottle 304 is removed from the first station 342 of the sump lid 300 for disposal in the same way that the toner bottle 102 of the first embodiment is removed from the first section 104 of the sump lid 100, (see FIGS. 12 and 13).

From the foregoing description, one skilled in the art can easily ascertain the essential characteristics of this invention and, without departing from the spirit and scope thereof, can make various changes and modifications of the invention to adapt it to various usages and conditions.

What is claimed is:

1. Toner dispensing apparatus for dispensing toner to an electrostatic reproducing machine, the apparatus comprising:

a toner container having a mouth with a flange extending therearound;

a flexible cover covering the mouth and having a portion releasably adhered to the flange by a layer of adhesive, the flexible cover having first and second ends, the first end being fixed to the flange;

a slide cover overlying the flexible cover and being slidably received on the flange, the slide cover having first and second ends with the second end of the flexible cover being fixed to the slide cover proximate one end thereof;

a sump lid having first and second stations for receiving the toner container, the second station having an opening through which toner from the container pours, and means for engaging the slide cover to retain the slide cover at the first station when the toner container is moved to the second station, wherein the flexible cover is peeled from the flange to open the container as the toner container is moved, and means for frictionally engaging the flexible cover to create drag thereon when the toner container is moved from the second station back to the first station wherein the flexible cover readheres to the flange covering the mouth of the container and the flange is slidably received in the slide cover.

2. The toner dispensing apparatus of claim 1, wherein the frictionally engaging means comprises a relatively high friction surface in engagement with releasable adhesive on the flexible cover.

3. The toner dispensing apparatus of claim 2, wherein the second end of the flexible cover is fixed proximate the second end of the slide cover, the second end of the slide cover being remote from the second station of the sump lid when the container is positioned in the sump lid.

4. The toner dispensing apparatus of claim 3, wherein the flexible cover is folded over double and wherein the mouth of the container is positioned closer to the first end of the slide cover than the second end of the slide cover, whereby the mouth of the toner container begins opening when the mouth is proximate the opening in the second station of the sump lid.

5. The toner dispensing apparatus of claim 3, wherein the flexible cover is folded over double and the slide cover has a length at least as long as the length of the flexible cover when the flexible cover is unfolded.

6. The toner dispensing apparatus of claim 5, wherein the slide cover has opposite groves along substantially the entire length thereof and said frictionally engaging means includes a foam layer facing the mouth of the container to retain toner between the foam layer and flexible cover as the toner container is slid.

7. The toner dispensing apparatus of claim 1, wherein the second end of the flexible cover is fixed proximate the first end of the slide cover, the first end of the slide cover being proximate the second station when the container is positioned in the sump lid.

8. The toner dispensing apparatus of claim 1, further including a sump cover for covering the opening in the second station, means for biasing the sump cover over the opening and means for displacing the sump cover against the biasing means upon sliding the toner container from the first station to the second station.

9. The toner dispensing apparatus of claim 8, wherein the means for displacing the sump cover is the flange on the container.

10. A method for dispensing toner to an electrostatic reproducing machine from a toner container having a mouth with a flange therearound, the flange being covered with a flexible cover and the flexible cover being overlaid with a slide cover slidably received on the flange, the method comprising the steps of:

mounting the toner container in a sump lid having a first station and a second station, the second station having an opening through which the toner passes to the reproduction machine and the first station initially receiving the toner container;

sliding the toner container from the first station to the second station to align the mouth of the container with the opening in the second station;

slidably removing the flange from the slide cover and peeling the flexible cover from the flange while sliding the toner container from the first to the second station to allow the toner to empty from the container;

after the toner is emptied, sliding the toner container from the second station to the first station; and simultaneously with sliding the toner container from the second station to the first station, recovering the mouth of the toner container with the flexible cover and sliding the flange back into slidable relation with the slide cover.

11. The method of claim 10, wherein the slide cover has a first end remote from the second station and a second end proximate the second station when the toner container is mounted in the first station, and wherein the step of peeling the flexible cover from the mouth of the container includes retaining one end of the flexible cover at one end of the ends of the slide cover.

12. The method of claim 11, wherein the flexible cover is retained at the first end of the slide cover.

13. The method of claim 11, wherein the flexible cover is retained at the second end of the slide cover.

14. The method of claim 10, wherein a sump lid cover is biased to a first position over the opening in the second station from a second position displaced from the opening and wherein the method further includes the step of moving the sump lid cover to the second position upon sliding the toner container from the first station to the second station.

* * * * *